US005377414A

United States Patent [19]

Buzzi et al.

[11] Patent Number: 5,377,414

[45] Date of Patent: Jan. 3, 1995

[54] SHAVING APPARATUS HAVING A FOIL-LIKE UPPER CUTTER AND A FOIL-LIKE LOWER CUTTER

[75] Inventors: Valentin Buzzi, Klagenfurt; Ferdinand Sereinig, Velden, both of Austria

[73] Assignee: U.S. Philips Corporation, New York, N.Y.

[21] Appl. No.: 146,512

[22] Filed: Nov. 1, 1993

[30] Foreign Application Priority Data

Nov. 25, 1992 [AT] Austria ..... 2335/92

[51] Int. Cl.[6] ..... B26B 19/26

[52] U.S. Cl. ..... 30/346.51; 30/43.3

[58] Field of Search ..... 30/43, 43.3, 43.9, 43.92, 30/346.51

[56] References Cited

U.S. PATENT DOCUMENTS

| | | | |
|---|---|---|---|
| 3,093,899 | 6/1963 | Futterer | 30/346.51 X |
| 3,261,097 | 7/1966 | Ritter | 30/346.51 |
| 3,382,380 | 3/1968 | Rinck et al. | 30/346.51 |
| 3,602,991 | 9/1971 | Heindrich et al. | 30/346.51 |
| 3,696,508 | 10/1972 | Messinger . | |
| 3,893,236 | 7/1975 | Nissen . | |
| 4,035,914 | 7/1977 | Blume et al. | 30/346.51 |
| 5,185,933 | 2/1993 | Messinger | 30/346.51 |
| 5,231,760 | 8/1993 | Vioster et al. | 30/43.3 X |

FOREIGN PATENT DOCUMENTS

| | | | |
|---|---|---|---|
| 0480499 | 4/1992 | European Pat. Off. . | |
| 2037871 | 7/1974 | Germany . | |
| 2607228 | 9/1976 | Germany | 30/346.51 |
| 62-148684 | 2/1987 | Japan . | |

*Primary Examiner*—Douglas D. Watts
*Attorney, Agent, or Firm*—Ernestine C. Bartlett

[57] ABSTRACT

In a shaving apparatus (1) comprising a foil-like lower cutter in the form of a cutter blade (68) and an upper cutter in the form of a shear foil (63) the cutter blade (68) has hexagonal hair-entry apertures (145) arranged in a honeycomb pattern, and the shear foil (63) has square hair-entry apertures (119) and a slot-shaped hair-entry aperture (120) between every two adjacent square hair-entry apertures (119), the direction of two parallel cutting edges (132, 134) of the square hair-entry apertures (119) of the shear foil (63) and the direction of two parallel cutting edges (153, 156) of the hexagonal hair-entry apertures (145) of the cutter blade (68) subtending an angle between 5° and 25°, preferably between 14° and 15°.

6 Claims, 3 Drawing Sheets

SHAVING APPARATUS HAVING A FOIL-LIKE UPPER CUTTER AND A FOIL-LIKE LOWER CUTTER

The invention relates to a shaving apparatus comprising a foil-like lower cutter having a shaving area defined by a circularly cylindrical surface and provided with hair-entry apertures which are separated from one another by webs and bounded by bounding surfaces, which lower cutter can be driven with a combined movement which is performed substantially along a circular path projected on a circularly cylindrical surface, and comprising a foil-like upper cutter having a shaving area engaging with the shaving area of the lower cutter and provided with hair-entry apertures which are separated from one another by webs and bounded by bounding surfaces, all the bounding surfaces of all the hair-entry apertures terminating in cutting edges.

A shaving apparatus of the type defined in the opening paragraph is known, for example, from EP 0,480,499 A1, which does not give any exact information about the aperture geometry of the hair-entry apertures of the foil-like upper cutter and of the foil-like lower cutter and about the arrangement of the hair-entry apertures relative to one another. This known shaving apparatus, which is referred to as a double-foil shaving apparatus, has hair-entry apertures which are only shown diagrammatically, suggesting a circular shape of the hair-entry apertures both in the upper cutter and in the lower cutter.

During the development of a double-foil shaving apparatus of the type defined in the opening paragraph, in which the foil-like lower cutter can be driven along a substantially circular path projected on a circularly cylindrical surface, several aperture geometries and arrangements of hair-entry apertures in the foil-like upper cutter and the foil-like lower cutter of such a double-foil shaving apparatus were examined but no satisfactory results could be obtained until now. In the scope of this development it has therefore been the object to find for such a shaving apparatus an aperture geometry and an arrangement of hair-entry apertures in a foil-like upper cutter and in a cooperating foil-like lower cutter which yield satisfactory results as regards a maximal perforation factor of the two cutters, an effective and frequent interception of hairs to be severed, a non-irritant and quick shave, a minimal risk of damaging of the two cutters, particularly the upper cutter, and a minimal wear and maximal lifetime of the two cutters. According to the invention this object is achieved in that in its planar condition the lower cutter has hair-entry apertures with six bounding surfaces terminating in six cutting edges arranged as a regular hexagon, said hexagonal hair-entry apertures being arranged in a honeycomb pattern, in its planar condition the upper cutter has hair-entry apertures with four bounding surfaces terminating in four cutting edges arranged as a square, each of these square hair-entry apertures belonging to two rows of square hair-entry apertures, which rows intersect one another at right angles, and a further hair-entry aperture is situated between every two adjacent square hair-entry apertures, which further hair-entry aperture has bounding surfaces terminating in cutting edges arranged in the form of a narrow slot, two of the cutting edges extending parallel to the adjacent cutting edges of the adjacent square hair-entry apertures, and when the cutters are superposed as in the shaving apparatus but are in their flat condition the direction of two mutually parallel cutting edges of the square hair-entry apertures of the upper cutter and the direction of two mutually parallel cutting edges of the hexagonal hair-entry apertures of the lower cutter subtend an angle between 5° and 25°. A shaving apparatus in which the lower cutter can be driven along a substantially circular path projected on a circularly cylindrical surface only yields good and satisfactory results as regards a high perforation factor of both cutters, an effective and frequent interception of hairs to be severed, a non-irritant and quick shave, a low risk of damage to the two cutters, and a low wear and long life when an aperture geometry and an aperture arrangement in accordance with the characteristic features defined above are used. The provision of square hair-entry apertures in combination with additional slit-shaped hair-entry apertures in the upper cutter results in a high perforation factor for the upper cutter and at the same time an effective and frequent interception of hairs to be severed which grow in different directions. The provision of a honeycomb pattern of hexagonal hair-entry apertures in the lower cutter also results in a high perforation factor. Moreover, the combination of square hair-entry apertures in conjunction with additional slit-shaped hair-entry apertures in the upper cutter and hexagonal hair-entry apertures in the tower cutter has the advantage that it also yields a high perforation factor for the cutter combination, which is very essential, and at the same time provides a non-irritant anti quick shave, which is not possible with other aperture shapes and aperture combinations. As a matter of fact, the combination of square hair-entry apertures in conjunction with additional slit-shaped hair-entry apertures in the upper cutter and a honeycomb pattern of hexagonal hair-entry apertures in the lower cutter effectively precludes an undesired penetration of the skin in the shaving area, so that a gentle shaving process is obtained, and at the same time, owing to the movement of the lower cutter along a circular path projected on a circularly cylindrical surface a multitude of cutting actions are obtained between the cutting edges of the two cutters in a plurality of cutting directions, which yields a rapid shave. By means of the inventive combination of square hair-entry apertures in conjunction with additional slit-shaped hair-entry apertures in the upper cutter and hexagonal hair-entry apertures in the lower cutter it is achieved that in spite of the desired narrow webs between the hair-entry apertures the two cutters interengage over a comparatively large area, which is advantageous for a low wear and a long life. Moreover, the arrangement of the cutting edges of the hair-entry apertures of the shear foil and the cutting edges of the hair-entry apertures of the upper cutter and the cutting edges of the hair-entry apertures of the lower cutter at an angle between 5° and 25° relative to one another has the advantage that when the two cutters are constructed in accordance with the invention, in spite of the large number of cutting edges, a cutting edge of the upper cutter can never assume a position parallel to a cutting edge of the lower cutter during shaving, so that hairs are always severed between two cutting edges which subtend a minimum angle with one another. This is advantageous for a minimal mechanical load and, consequently, a minimal risk of breakage of the webs between the hair-entry apertures, particularly for the generally thin foil-like upper cutter, which minimizes the risk of damage to the cutters, particularly the thin upper cutter.

It is to be noted that U.S. Pat. No. 3,893,236 discloses a shaving apparatus having a foil-like upper cutter and a foil-like lower cutter, in which both the upper cutter and the lower cutter have exclusively square hair-entry apertures, the length of the sides of the square hair-entry apertures in the lower cutter being approximately four times that of the hair-entry apertures in the upper cutter, and in which in contradistinction to the shaving apparatus in accordance with the invention the lower cutter is drivable along a path of movement which also corresponds to a square. Owing to the provision of only square hair-entry apertures the upper cutter in such a known shaving apparatus has a less satisfactory perforation factor and a poor capture efficiency for hairs growing in different directions. As a result of the choice of similar square shapes for the apertures in such a known shaving apparatus there is an increased likelihood of the skin penetrating into the shaving area. Moreover, in such a shaving apparatus having only square hair-entry apertures and having a lower cutter which is drivable along a path of movement corresponding to a square cutting is possible in only four cutting directions, which results in a comparatively slow shaving process, whereas in a shaving apparatus in accordance with the invention cutting is possible in a multitude of cutting directions, which results in a more rapid shaving process. In addition, driving the lower cutter along a path of movement corresponding to a square requires a comparatively intricate and therefore expensive and vulnerable drive mechanism, in which the path of movement corresponding to a square gives rise to undesirably high acceleration forces during the direction reversals and to excessive vibrations and annoying noise.

Moreover, it is to be noted that from JP-A 62-148,684 a shaving apparatus is known which has a foil-like upper cutter but a stiff lower cutter, which is reciprocable only parallel to the cylinder axis of the cylindrical surface defining its shaving area. The hair-entry apertures of the lower cutter are nothing but mutually parallel hollow cylinders of hexagonal cross-section so that these hair-entry apertures have six bounding surfaces, but owing to the simple reciprocatory driving movement of the lower cutter only those bounding surfaces of the hair-entry apertures which extend transversely of the cylinder axis of the cylindrical surface defining the shaving area form cutting edges at their ends. Neither is it possible to derive from such a known shaving apparatus and from its lower cutter, apart from the hexagonal shape of the hair-entry apertures, any teachings for a shaving apparatus in accordance with the invention having a foil-like lower cutter which is drivable along a substantially circular path projected on a circularly cylindrical surface. Indeed, such a known lower cutter is wholly unsuitable for a shaving apparatus in accordance with the invention because, as a result of the construction of the hair-entry apertures as mutually parallel hollow cylinders, the bounding surfaces which do not extend transversely of the cylinder axis of the cylindrical surface defining the shaving area and which are situated farther from the apex of the lower cutter form edges at their ends, which edges do not exhibit a cutting angle suitable for cutting hairs in a shaving apparatus in accordance with the invention. In a shaving apparatus in accordance with the invention, in contradistinction to the known shaving apparatus, the lower cutter is of a foil-like construction and, in fact, the hair-entry apertures only exhibit the shape of a regular hexagon when the lower cutter is in a planar condition. In the arcuate condition after mounting in the shaving apparatus in accordance with the invention the hair-entry apertures, strictly speaking, have shapes which deviate from regular hexagons, all the bounding surfaces of the hair-entry apertures essentially pointing towards the cylinder axis of the circularly cylindrical surface defining the shaving area, so that advantageously at the ends of all the bounding surfaces cutting edges are formed with cutting angles suitable for severing hairs, as a result of which a multitude of cutting actions in a plurality of cutting directions are possible, thus permitting rapid shaving.

Furthermore, it is to be noted that U.S. Pat. No. 3,696,508 discloses a shaving apparatus having a foil-like upper cutter and a lower cutter formed by juxtaposed stiff cutter lamellae which is drivable only parallel to the cylinder axis of the cylindrical surface defining the shaving area formed by the cutter lamellae. From this prior-art shaving apparatus it is known per se to provide a foil-like upper cutter with square hair-entry apertures and with hair-entry slits between every two square hair-entry apertures in order to achieve a satisfactory perforation factor and a good capture efficiency but it is not possible to derive from this known shaving apparatus any further teachings for a shaving apparatus in accordance with the invention which has a foil-like lower cutter which is drivable along a substantially circular path projected on a circularly cylindrical surface.

Moreover, it is to be noted that merely combining the steps known from the three afore-mentioned publications does not result in the whole combination of characteristic features necessary lot realizing a shaving apparatus in accordance with the invention. An inventive effort surpassing the prior art is required to arrive at this combination of characteristic features of the invention.

In a shaving apparatus in accordance with the invention it is found to be particularly advantageous if the angle has a value between 14° and 15°. In practice, such a construction yields very favourable and advantageous shaving results.

It also proves to be very advantageous if in a planar condition of the lower cutter two mutually parallel cutting edges of the hexagonal hair-entry apertures of the lower cutter extend substantially perpendicularly to a straight line parallel to the cylinder axis of the circularly cylindrical surface of the shaving area of the lower cutter. With such a construction of the lower cutter it has been found that during grinding of the lower cutter, when the lower cutter in its arcuate operating condition is reciprocated relative to a flat grinding wheel, the webs of the lower cutter which extend transversely of the cylinder axis of the circularly cylindrical surface defining the shaving area of the lower cutter are ground off to a slightly larger degree, i.e. approximately 3 to 5 μm more, than the other webs of the lower cutter, which has the advantage that it leads to a reduced friction between the two foil-like cutters during shaving.

It is also found to be advantageous if in a planar condition of the upper cutter each of the hair-entry apertures situated between two adjacent square hair-entry apertures of the upper cutter has two long cutting edges, which extend parallel to the adjacent cutting edges of the adjacent square hair-entry apertures, and four short cutting edges, of which each time two short cutting edges converge to a wedge shape and of which each time two short cutting edges extend parallel to one of the two diagonal directions of the adjacent square hair-entry apertures. In this way a foil-like upper cutter can be realized which has the advantage that the narrow webs between the hair-entry apertures of the upper cutter can all have the same width.

The invention will now be described in more detail with reference to the drawings, which show an exemplary embodiment to which the invention is not limited.

FIG. 1 is an oblique view of a shaving apparatus in accordance with the invention having a shaving head on which a foil-like upper cutter, generally referred to as a shear foil, and a foil-like lower cutter, generally referred to as a cutter blade, cooperate with one another.

FIG. 2 is an enlarged-scale cross-sectional view showing the shaving head with a shaving-head frame and a foil frame which is movably guided and spring-mounted relative to the shaving-head frame and which holds the shear foil, and the part adjacent the shaving head of the shaving apparatus shown in FIG. 1, in which part a drive means for driving the cutter blade cooperating with the shear foil is situated.

Figure 1:
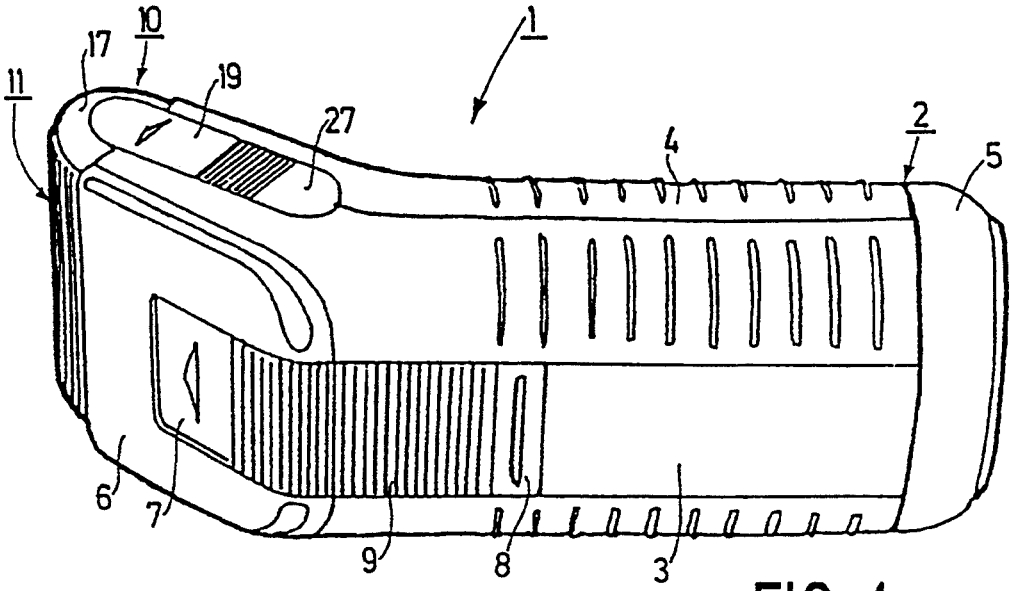

FIG. 1 shows a shaving apparatus 1 having a housing 2 comprising two interconnected housing halves 3 and 4 completed by a trough-shaped housing section 5 at the bottom. A trimmer, not shown in FIG. 1, is arranged at the location of the housing half 3 and is movable between a rest position, in which it is retracted into the shaving apparatus 1, and an operating position, in which it is slid out of the shaving apparatus 1, said trimmer being concealed by a cover plate 6 in the rest position so that only a cutter support 7 of the trimmer is partly visible. To move the trimmer, not shown in FIG. 1, the shaving apparatus 1 has an actuating element 8, which is connected to the cutter support 7 of the trimmer by a shutter-like flexible coupling member 9.

A shaving head 10 is mounted on the housing 2 of the shaving apparatus 1 and is detachably connected to the housing 2. The shaving head 10 has a foil-like upper cutter, which can also be covered by means of a shutter-like cover 11, which is movable substantially parallel to the main wall of the housing half 4 between a cover position shown in FIG. 1, in which it covers the foil-like upper cutter, and an open position, in which it exposes the shear foil to permit shaving.

The shaving head 10 of the shaving apparatus 1 will now be described with reference to FIG. 2. The shaving head 10 comprises a metal shaving-head frame 12 formed by a zinc die-casting comprising a two longitudinal side walls 13, a first transverse side wall 14 and a second transverse side wall 15. A first chromium-plated plastics part 16 and 17, respectively, and a second plastics part 18 and 19, respectively, are connected to the shaving-head frame 12 at the location of the two transverse side walls 14 and 15 in that the chromium-plated plastics parts 16 and 17 are first slid onto the shaving-head frame 12 from the side which is remote from the shaving apparatus 1, after which the two other plastics parts 18 and 19, with the shaving head 10 still detached from the shaving apparatus 1, are slid onto the two chromium-plated plastics parts 16 and 17 from the side facing the shaving apparatus 1 and are each connected by means of a pin-and-socket joint 20 and 21, respectively, in that the pins engage the sockets of the pin-and-socket joints 20 and 21. The plastics parts 17, 18 and 19, 20 may be regarded as parts of the shaving-head frame 12, which consequently comprises several parts. However, alternatively it may be constructed as a single part. The two plastics parts 18 and 19 are extended with respect to the shaving-head frame 12 in a direction towards the shaving apparatus 1. At their facing inner sides the two plastics parts 18 and 19 each have a latching nose 22 and 23, respectively, which can be retained by means of a latching hook 24 and 25, respectively. In this way the shaving head 10 is fastened to the housing 2 of the shaving apparatus I. The latching hooks 24 and 25 are arranged on push-buttons 26 and 27, respectively, which can be actuated by hand and which are movably supported in the housing 2 of the shaving apparatus 1, which push-buttons are both movable towards the interior of the apparatus against the force of blade springs 28 and 29, respectively, supported in the housing 2, in order to enable the shaving head 10 to be detached.

A foil frame 30 is mounted on the shaving-head frame 12 so as to be movable in the direction of an axis 31 perpendicular to an apex line of the foil-like upper cutter. The foil frame 30 can be fitted into and retained in the shaving-head frame 12 through the frame side facing the housing 2, i.e. through the frame opening of the shaving-head frame 12. The foil frame 31, like the shaving-head frame 12, has two longitudinal side walls 32, a first transverse side wall 33 and a second transverse side wall 34. A cylindrical portion 37 and 38, respectively, is connected to each of the two transverse side walls 33 and 34 via a web 35 and 36, respectively. The cylindrical portion 38 is shown in cross-section and the cylindrical portion 37 is shown not in cross-section in FIG. 2. The cylindrical portion 37 engages a hollow cylindrical guide chamber 39 in the first transverse side wall 14 of the shaving-head frame 12 with only little clearance. The guide chamber 39 adjoins a release slot 40, through which the web 35 is passed. The cylindrical portion 38 engages a guide chamber 41 of substantially rectangular cross-section in the second transverse side wall 15 of the shaving-head frame 12 with a comparatively large clearance in the direction of the longitudinal side walls 13 and 32 but only a small clearance in a direction transverse thereto, which chamber adjoins a release slot 42, through which the web 36 extends. In this way the cylindrical portions 37 and 38 and the guide chambers 39 and 41 guide the foil frame 30 relative to shaving-head frame 12 so as to be movable in the direction of the axis 31.

Figure 2:
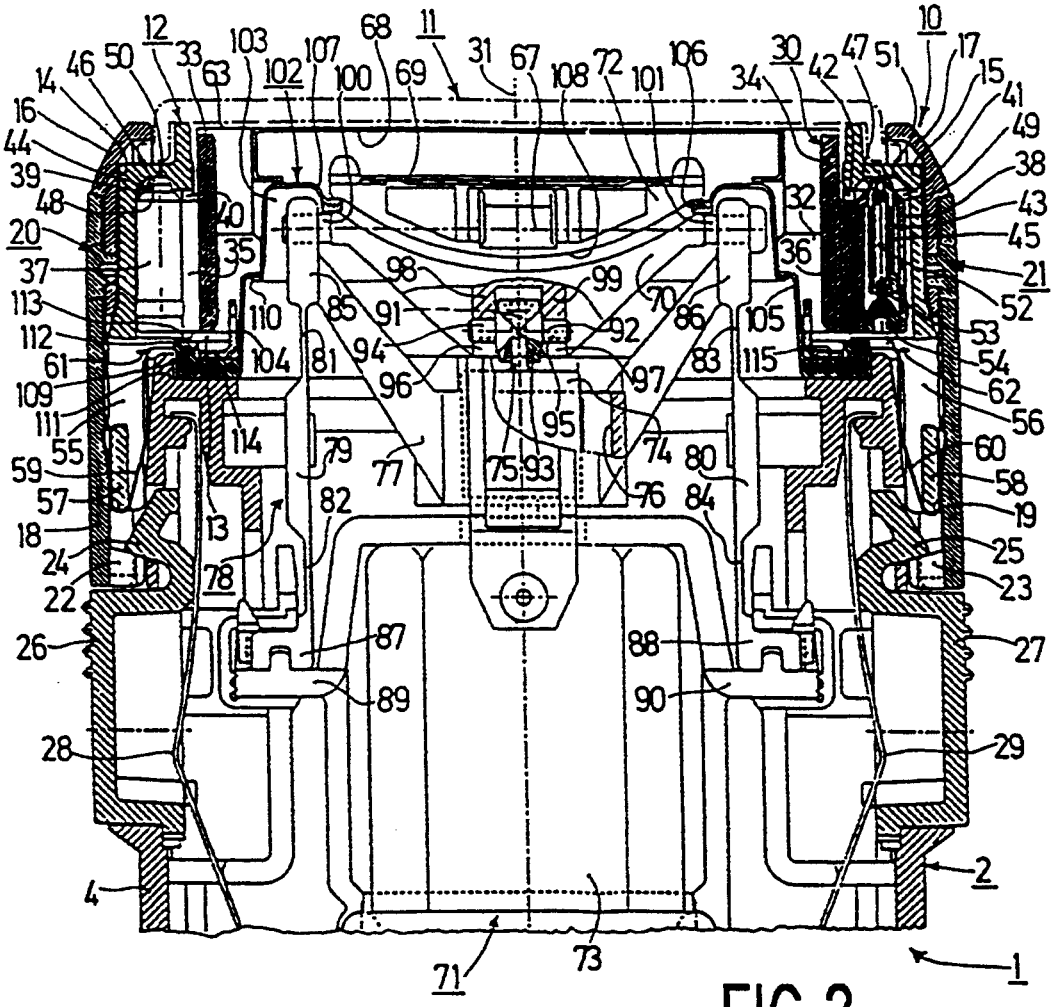

The two cylindrical portions 37 and 38, as is shown for the portion 38 in FIG. 2, each have a circumferentially closed hollow cylindrical duct 43. Each duct 43 is slidably engaged by a sleeve 44 and 45, respectively, forming a piston-like pressure member. With its substantially closed end 46, 47 each of the sleeves 44 and 45, respectively, extends from the respective duct 43 through a hole formed in the upper area 48 or 49 of the respective portion 37 or 38 and abuts against an upper bounding wall 50, 51 of the respective guide chamber 39 or 41. In each of the hollow cylindrical bores 52 of the respective sleeves 44 and 45 a helical pressure spring 53 extends to the bottom of the respective sleeve 45. The end of each helical pressure spring 53 which is remote from the sleeve bottom acts against a closing member 54, which is formed by an insert pressed into the respective duct 43 to close this duct 43. In this way the two helical pressure springs 53 provide a spring load between the foil frame 30 and the shaving-head frame 12. As a result, the helical pressure springs 53 tend to move the foil frame 30 relative to the shaving-.head frame 12, which is fixed to the housing 2 of the shaving apparatus 1 by the latching hooks 24 and 25, towards the shaving apparatus 1 parallel to the axis 31. This has the advantage that the helical pressure springs 53 are captively retained and protected against soiling inside the ducts 43 and the helical pressure springs 53 act on the shaving-head frame 12 via the sleeves 44 and 45, the cylindrical portions 37 and 38 with the inserts 54 and the upper bounding walls 50 and 51 forming contact portions for the helical pressure springs 53 on the foil frame 31 and the shaving-head frame 12.

In order to limit the movement possibility of the foil frame 30 relative to the shaving-head frame 12, i.e. in order to hold the foil frame 30 in the shaving-head frame 12 when this frame 12 is removed from the shaving apparatus 1 and prevent it from falling out, the present shaving apparatus 1 has the following very simple and advantageous provisions. The two transverse side walls 14 and 15 of the shaving-head frame 12 are extended relative to the two transverse side walls 33 and 34 of the foil frame 30 in the direction of the housing 2 of the shaving apparatus 1 and each have a wall extension 55 and 56, respectively, which wall extensions project from the shaving-head frame 12 towards the shaving apparatus I and are covered by the plastics parts 18 and 19. These wall extensions 55 and 56 are substantially U-shaped and each have a bridge portion 57 and 58, respectively, connecting the two limbs. Blade springs 59 and 60, which extend substantially in the direction of the wall extension 55 or 56, respectively, towards the foil frame 30, are connected to the two bridge portions 57 and 58, respectively, and act as positive locking devices. The two blade springs 59 and 60 serve as movable latches with whose respective free ends 61 and 62 the foil frame 30 can be retained positively in the shaving-head frame 12 in that the free ends 61 and 62 of the blade springs 59 and 60, respectively, act at the location of the cylindrical portions 37 and 38, respectively, and on the respective closing members 54 at this location and thus take up the forces exerted by the helical pressure springs. In this way the foil frame 30 is reliably secured in the shaving-head frame 12 with simple means, the construction of the latching devices as blade springs 59 and 60 further having the advantage of a very simple mounting and removal of the foil frame 30 into and from the shaving-head frame 12. To mount the foil frame 30 it is simply inserted between the two blade springs 59 and 60, which serve as latches and which then deflect, and it is then also ensured advantageously that the sleeves 44 and 45 cooperate with the bounding walls 50 and 51 provided for this purpose. To remove the foil frame 30 the blade springs 59 and 60 are simply pressed apart by hand, after which the foil frame 30 is initially pressed out of the shaving-head frame 12 under the influence of the helical pressure springs 53 and can subsequently be pulled freely out of the shaving-head frame 12. The positive locking of the foil frame 30 in the shaving-head frame 12 by means of the blade springs 59 and 60 acts only in a direction parallel to the axis 31, no positive locking action being exerted on the foil frame 30 by the blade springs 59 and 60 in a direction transverse to the axis 31.

Figure 3:
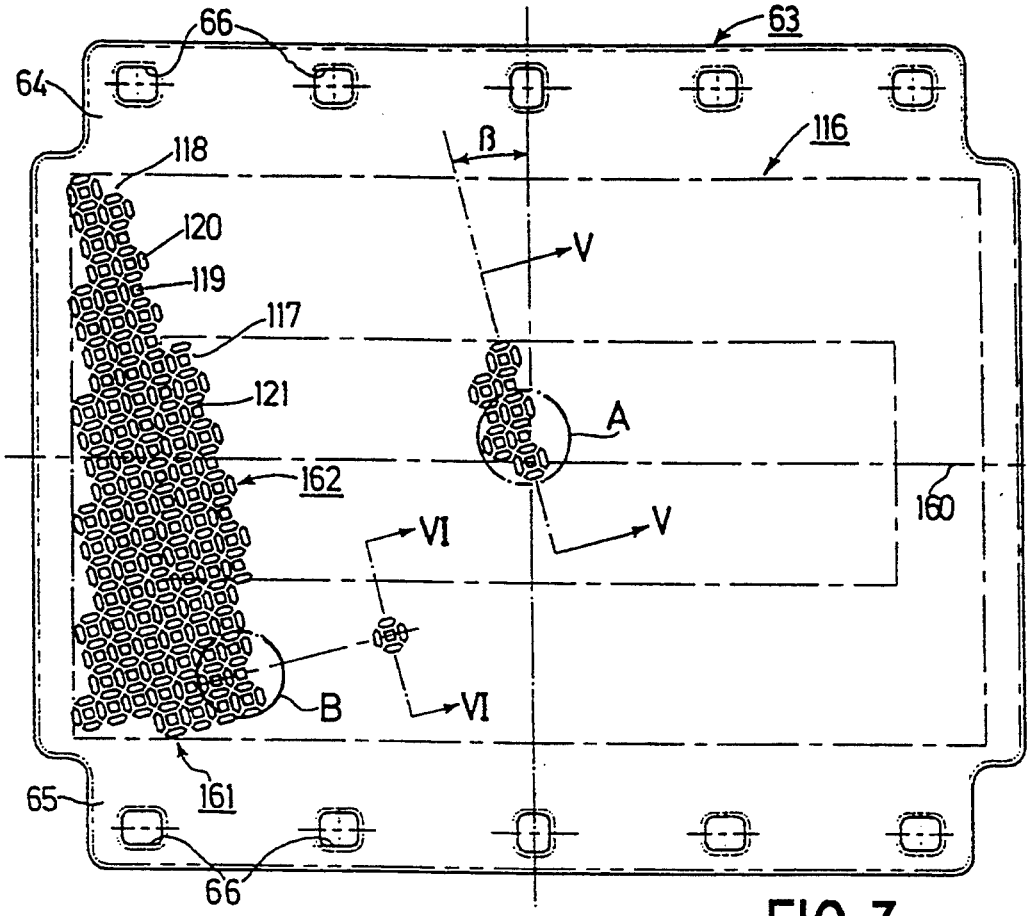
FIG. 3 is a larger than actual size plan view showing the shear foil of the shaving apparatus in FIGS. 1 and 2, which shear foil has a central perforate zone and a peripheral perforate zone.

The foil frame 30 serves for holding the afore-mentioned foil-like upper cutter of the shaving head 10, which in the present case is formed by a shear foil 63, which is shown in detail in FIG. 3. The present shear foil 63 has two longitudinal edge portions 64 and 65 attached to the two longitudinal side walls 32 of the foil frame 30 by means of mounting holes 66 in a manner not shown. The shear foil 63 then assumes an arched shape relative to an axis 67 perpendicular to the axis 31, so that its zone formed with hair-entry apertures constitutes a shaving area which is arched relative to the axis 67.

The shear foil 63 cooperates with a lower cutter 68, which in the present shaving apparatus 1 is of a foil-like construction, the foil thickness of the lower cutter 68 being larger than the foil thickness of the shear foil 63. The foil-like lower cutter 68, which is generally referred to as a cutter blade, is secured to a lower-cutter support 69, to which the longitudinal edges 70 and 71 of the cutter blade 68 are connected in a manner, not shown. The cutter blade 68 also has an arched shape relative to the axis 67. The cutter blade also has hair-entry apertures, the zone of the blade 68 with the hair-entry apertures also constituting a shaving area which is arched relative to the axis 67. In the shaving apparatus 1 both the shaving area of the cutter blade 68 and the shaving area of the shear foil 63 engaging therewith are shaped as circularly cylindrical surfaces.

The lower cutter support 69 together with the cutter blade 68 secured thereto is connected to a drive member 70 of a drive means 71 of the shaving apparatus 1, the lower cutter support 69 being mounted and latched onto a driving portion 72 of the drive member 70. The drive means 71 will be described briefly hereinafter. For the drive means 71 reference is made to EP 0,447,469 A1 from which a shaving apparatus 1 comprising such a drive means is known and which is herewith incorporated by reference.

The drive means 71 comprises a motor 73, whose rotatably drivable motor shaft, not shown in FIG. 2, is connected to a rotatably drivable eccentric 74 from which a pin 75 projects which is eccentric relative to the shaft of the motor 73. In the present case the eccentric 74 extends through an opening 76 in a substantially V-shaped coupling portion 77 of a reciprocating bridge 78. In addition to the V-shaped coupling portion 77 the reciprocating bridge comprises two limbs 79 and 80, which each have two integral-hinge portions 81, 82 and 83, 84, respectively, and which are each connected to the V-shaped coupling portion 77 by a connecting portion 85 and 86, respectively, adjoining the integral-hinge portions 81 and 83, respectively, and which are each secured to a stationary mounting portion 89 and 90, respectively, of the apparatus by a fixing portion 87 and 88, respectively, connected to the other integral-hinge portions 82 and 84, respectively.

The eccentric pin 75 of the eccentric 74 projects into a bore 91 in a transmission member 93 having a cylindrical shape relative to an axis 92 parallel to the axis 67, from which two cylindrical projections 94 and 95 project laterally, which projections are coaxial with the axis 92. These projections 94 and 95 engage two slots 96 and 97 which are open towards the eccentric 74 and which have two tabs 98 and 99 projecting from the drive member 70. The drive member 70, which can be driven by the eccentric pin 75 via the transmission member 93, has two cylindrical lateral projections 100 and 101 which are coaxial with the axis 67 and which are rotatable or pivotable in two slots in the connecting portions 85 and 86, which slots are open towards the cutter blade 68.

The limbs 79 and 80 of the reciprocating bridge 78 are stiff in the direction of the axis 31, so that the drive member 70, which is pivotably supported in the connecting portions 85 and 86, and the cutter blade 68, which is connected to the drive member 70 via the lower cutter support 69, can perform no or only a negligibly small movement in the direction of the axis 31. However, the limbs 79 and 80 are highly flexible in the direction of the axis 67, allowing the cutter blade 68 to perform a reciprocating oscillatory movement parallel to the axis 67. In the present shaving apparatus 1, in addition to this reciprocating movement of the cutter blade 68, a swinging movement about the axis 67 is imparted to the cutter blade 68 via the drive means 71 described above, which swinging movement is superposed on the reciprocating movement parallel to the axis 67, so that in the present shaving apparatus 1 the cutter blade 68 performs a combined movement which consists of a linear reciprocating movement and a swinging movement and which takes a substantially circular path projected onto the afore-mentioned circularly cylindrical surface on which the shaving areas of the cutter blade 68 and the shear foil 63 are situated.

Thus, in the present shaving apparatus 1 the lower cutter 68 is supported stiffly in the direction of the axis 31. The shear foil 63 is pressed against the cutter blade 68 thus supported in that the shear foil 63, which is secured to the foil frame 30, is loaded by the helical pressure springs 53, which bear against the shaving-head frame 12 via the sleeves 44 and 45. In this way, the shear foil 63 in the present shaving apparatus 1 is spring-loaded relative to the cutter blade 68. This spring load ensures that the shear foil 63 and the cutter blade 68 always interengage correctly, which guarantees a satisfactory shaving performance and shaving quality, the shaving performance of the shaving apparatus 1 being very high owing to the combined movement of the cutter blade 68.

In order to preclude the ingress of shaving particles into the shaving apparatus 1 at the location of the drive means 71 the shaving apparatus 1 has a dust seal 102. The dust seal 102 is made of an elastic material, i.e. of rubber. The dust seal 102 has hood-like and trough-like shape and is arranged around the block-shaped drive member 70. The dust seal 102 has four side wails, of which FIG. 2 shows the side walls 103, 104, and 105. The dust seal 102 further has an end portion 107 connecting the dust seal 102 to the drive member 70, which end portion bounds the four side walls at their ends facing the cutter blade 68 and has an opening 106 for the passage of the driving portion 72 of the drive member 70. For this purpose the drive member 70 has a continuous circumferential groove 108 in which the dust seal 102 engages with its wall portions bounding the opening 106 in the end portion 107. The dust seal 102 further has a peripheral portion 109 with which the dust seal 102 engages against a stationary zone of the housing, which peripheral portion bounds the four side walls at their ends which are remote from the cutter blade 68. The dust seal 102 further has a shoulder 110 extending along all the four side walls.

As is shown in FIG. 2, the peripheral portion 109 of the dust seal 102 engages a step 111 which is formed inside the housing and which is open towards the shaving head 10. Moreover, the dimension of the peripheral portion 109 in the height direction of the step I 11 is selected in such a manner that the peripheral portion 109 of the dust seal 102 presses against an area 113 of the shaving head 10 or its shaving-head frame 12 with a peripheral zone 112 which is free from the step 111. This prevents mechanical vibrations between the housing 2 of the shaving apparatus 1 and the shaving head 10 and its shaving-head frame 12, so that such vibrations cannot give rise to noise and a silently operating shaving apparatus is obtained. The dust seal 102 is secured in the shaving apparatus 1 by means of two resilient clips 114 and 115. The resilient clips 114 and 115 are passed through recesses in the comers of the peripheral portion 109 of the dust seal 102 and are clamped onto ridges on the housing with their bent end portions.

The construction of the shear foil 63 of the shaving apparatus 1 will now be described in detail with reference to FIGS. 3 to 6. The shear foil 63 has a perforate area 116 consisting of a central perforate zone 117 and a peripheral perforate zone 118 surrounding the central perforate zone 117 at all sides. In FIG. 3 the two perforate zones 117 and 118 are each indicated by a dash-dot line surrounding the relevant zone. The perforate area 116 has adjacent hair-entry apertures 119 and 120, which are separated from one another by webs 121 and which are bounded by bounding surfaces 122, 123, 124, 125 and 126, 127, 128, 129, 130, 131, respectively. All these bounding surfaces 122 to 131 of all the hair-entry apertures 119 and 120 form cutting edges 132, 133, 134, 135 and 136, 137, 138, 139, 140, 141, respectively. In the central perforate zone 117 the webs 121 have a smaller thickness than in the peripheral perforate zone 118. The webs 121 are constructed as channel-like hollow webs forming raised edges 142 of the apertures, as is shown in FIGS. 5 and 6.

Figure 4A:
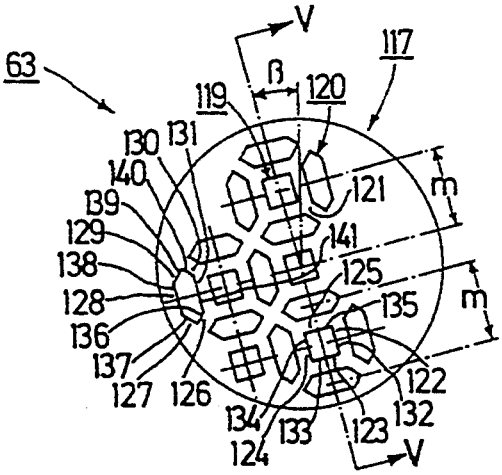
FIG. 4 shows, to an enlarged scale in comparison with FIG. 3, a detail A illustrating the form and arrangement of the hair-entry apertures in the central perforate zone and a detail B illustrating the form and arrangement of the hair-entry apertures in the peripheral perforate zone.
Figure 4B:
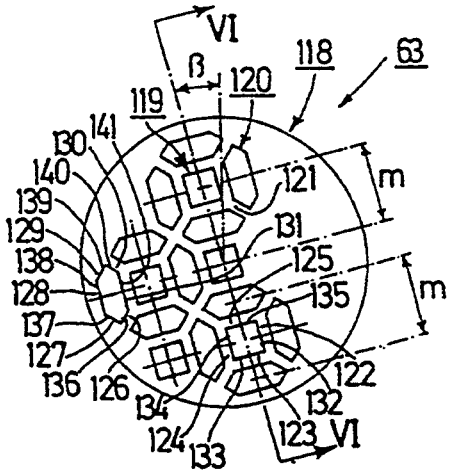
Figure 5:
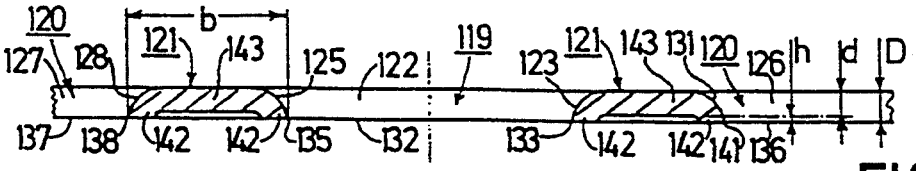
FIG. 5 shows the form of the hair-entry apertures and the form of the hollow webs between the hair-entry apertures in the central perforate zone of the shear foil in a sectional view taken on the line V—V in FIGS. 3 and 4 and to an enlarged scale in comparison with FIG. 3.
Figure 6:
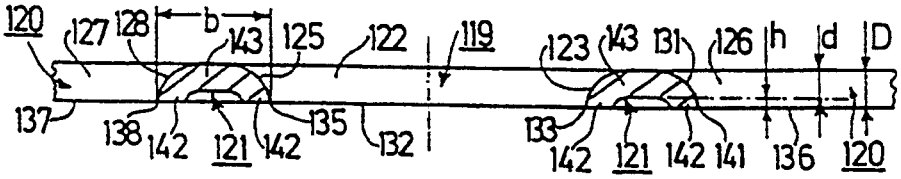
FIG. 6 shows the form of the hair-entry apertures and the form of the hollow webs between the hair-entry apertures in the peripheral perforate zone of the shear foil in a sectional view taken on the line VI—VI in FIGS. 3 and 4 and to an enlarged scale in comparison with FIG. 3.

As is also apparent from FIGS. 5 and 6, the raised edges 142 of the hollow webs 121 in the central perforate zone 117 have a smaller height h than in the peripheral perforate zone 118, so that the shear foil 63 of the shaving apparatus 1 has a smaller overall thickness D in the central perforate zone 117 than in the peripheral perforate zone 118. As is further apparent from FIGS. 5 and 6, the areas 143 of the hollow webs 121 of the shear foil which are situated between the raised edges 142 have a smaller thickness d in the central perforate zone 117 than in the peripheral perforate zone 118, the thickness d in each of these areas 143 being essentially the same. Finally, FIGS. 4, 5 and 6 show that the shear foil 63 has a perforate area 116 in which for the same centre-to-centre distance m between the centres of two like hair-entry apertures 119 and 120 in the central perforate zone 117 and in the peripheral perforate zone 118, respectively, the hollow webs 121 in the central perforate zone 117 have a larger width b than in the peripheral perforate zone 118.

For example, the dimensions listed in the following Table have been found to be favourable in practice.

| | central zone | peripheral zone |
|---|---|---|
| aperture edge height h | 0.009 mm | 0.015 mm |
| hollow web thickness d | 0.033 mm | 0.037 mm |
| overall thickness D | 0.042 mm | 0.052 mm |
| hollow web width b | 0.200 mm | 0.160 mm |

Figure 7:
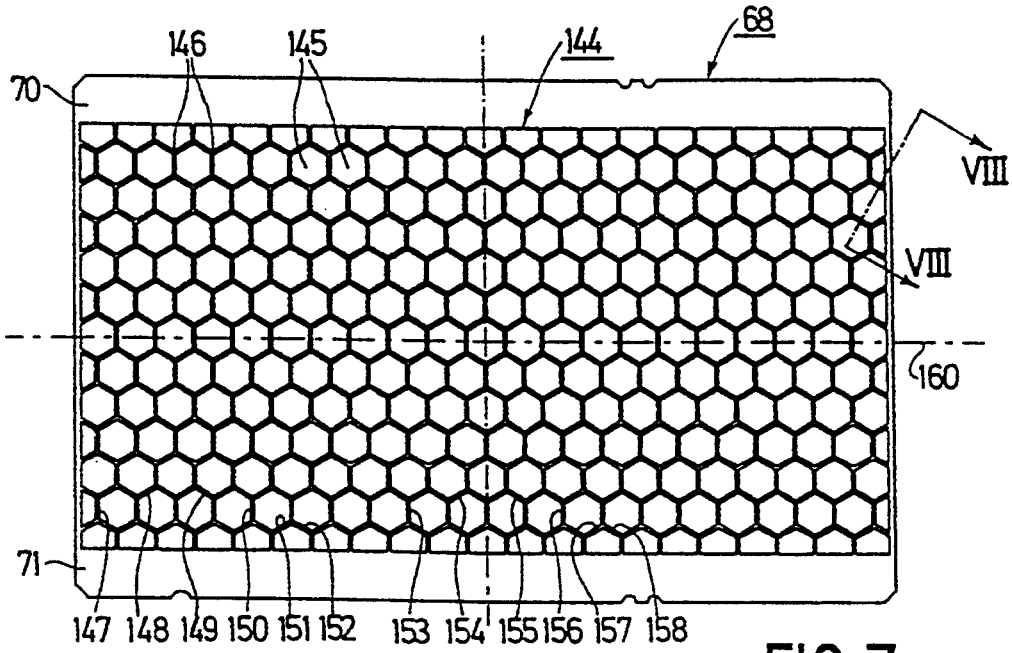
FIG. 7 is a larger than actual size plan view showing the cutter blade of the shaving apparatus in FIGS. 1 and 2.
Figure 8:
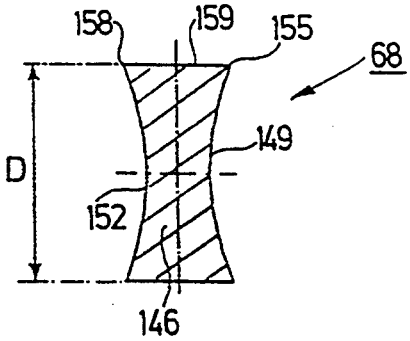
FIG. 8 shows the webs between the hair-entry apertures in the cutter blade in a sectional view taken on the line VIII—VIII in FIG. 7 and to an enlarged scale in comparison with FIG. 7.
Figure 9:
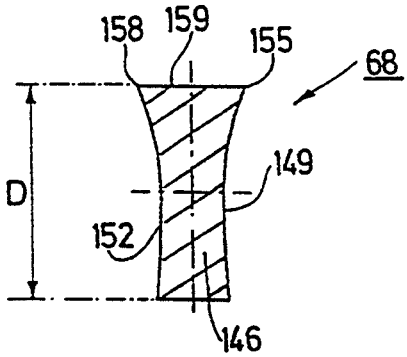
FIG. 9, in the same way as FIG. 8, shows the webs between the hair-entry apertures in a cutter blade which, apart from the modified form of the webs, is of the same construction as the cutter blade shown in FIG. 7.

The construction of the cutter blade 68 of the shaving apparatus 1 will now be described in detail with reference to FIGS. 7 and 8. The cutter blade 68 has a perforate area 144 formed with adjacent hair-entry apertures 145. The hair-entry apertures 145 are separated from one another by webs 146 and are bounded by bounding surfaces 147, 148, 149, 150, 151,152. All these bounding surfaces 147 to 152 of all the hair-entry apertures 145 terminate in cutting edges 153, 154, 155, 156, 157, 158. FIG. 8 shows the cross-sectional shape of the webs 146 between the hair-entry apertures 145. As is shown, the webs 146 of the cutter blades 68 are not constructed as channel-like webs forming raised edges for the apertures, so that the webs 146 do not have raised edges but in their areas which are adapted to cooperate with the shear foil 63 they have a flat bounding surface 159 in the extended condition of the cutter blade. The bounding surfaces bounding a web 146 of the cutter blade 68 shown in FIGS. 7 and 8 have opposite concave shapes, as is shown in FIG. 8. However, these bounding surfaces may also have a different shape, as is shown in FIG. 9. In practice, an overall thickness D of the cutter blade of 0.3 mm is found to be advantageous.

In its planar condition the cutter blade 68 has hair-entry apertures 145 having bounding surfaces 147, 148, 149, 150, 151,152 terminating in six cutting edges 153, 154, 155, 156, 157, 158 arranged as a regular hexagon, the hexagonal hair-entry apertures 145 being arranged in a honeycomb pattern. In a planar condition of the cutter blade 68 two mutually parallel cutting edges 153 and 156 of the hexagonal hair-entry apertures 145 of the cutter blade 68 extend perpendicularly to a straight line 160 parallel to the cylinder axis of the circularly cylindrical surface of the shaving area of the cutter blade 68 and shown as a dash-dot line in FIGS. 7 and 3. It is to be noted that not only the shaving area of the cutter blade 68 but also the shaving area of the shear foil 63, which cooperates with the cutter blade 68 in the assembled condition, is situated on said circularly cylindrical surface.

In its planar condition the shear foil 63 has hair-entry apertures 119 having bounding surfaces 122, 123, 124, 125 terminating in four cutting edges 132, 133, 134, 135 arranged as a square each of these square hair-entry apertures 119 belonging to two rows 161 and 162 of square hair-entry apertures 119, which rows intersect one another at right angles, and a further hair-entry aperture 120 being situated between every two adjacent square hair-entry apertures 119, which further hair-entry aperture 120 has bounding surfaces 126, 127, 128, 129, 130, 131 terminating in cutting edges 136, 137, 138, 139, 140, 141 arranged in the form of a narrow slot, two of the cutting edges 138 and 141 extending parallel to the adjacent cutting edges 132, 133, 134, 135 of the adjacent square hair-entry apertures 119.

In a planar condition of the shear foil 63 each of the hair-entry apertures 120 situated between two adjacent square hair-entry apertures 119 of the shear foil 63 has two long cutting edges 138 and 141, which extend parallel to the adjacent cutting edges 132, 133, 134, 135 of the adjacent square hair-entry apertures 119, and four short cutting edges 136, 137, 139, 140, of which two short cutting edges 136, 137 and 139, 140, respectively, converge to a wedge shape and of which each time two short cutting edges 136, 139 and 137, 140 extend parallel to one of the two diagonal directions of the adjacent square hair-entry apertures 119.

When the cutters 63 and 68 are superposed as in the shaving apparatus 1 but are in their flat condition the direction of two mutually parallel cutting edges 132, 134 of the square hair-entry apertures 119 of the shear foil 63 and the direction of two mutually parallel cutting edges 153, 156 of the hexagonal hair-entry apertures 145 of the cutter blade 68 subtend an angle $\beta$. The angle $\beta$ may have a value between 5° and 25°. In the shaving apparatus 1 the angle $\beta$ is 14.55° because this is found to be an optimum value for the shaving apparatus 1.

As a result of the above construction of the shear foil and the cutter blade it has been achieved that substantially the entire large-area zone of the shear foil with which the cutter blade chiefly cooperates has an overall thickness which is favourable, i.e. minimal, in view of an optimum shaving quality, and that at the same time in its area surrounding the area which mainly cooperates with the cutter blade the shear foil has an overall thickness which is advantageous in view of a maximal stability and a maximal flexural strength. The thin construction of the shear foil in its entire large-area central perforate zone results in a very high shaving quality over a large active shaving area, which is favourable in order to minimize the shaving time. Another advantage is that the two cooperating cutters of the shaving apparatus, i.e. the shear foil and the cutter blade, can be manufactured comparatively simply and cheaply. The shape and arrangement of the hair-entry apertures in the shear foil and in the cutter blade as described above have several advantages which are essential for such a shaving apparatus in which the cutter blade can be driven substantially along a circular path projected onto a circularly cylindrical surface defined by its shaving area. The provision of square hair-entry apertures in combination with additional slit-shaped hair-entry apertures in the shear foil results in a high perforation factor for the shear foil and at the same time an effective and frequent interception of hairs to be severed which grow in different directions. The provision of a honeycomb pattern of hexagonal hair-entry apertures in the cutter blade also results in a high perforation factor. Moreover, it has been found that with these apertures the combined perforation factors of such a shear foil and such a cutter blade are also favourable. This has the advantage that at the same time a non-irritant and quick shave is possible.

As a matter of fact, the present combination of apertures has preyed to be very favourable as regards an undesired penetration of the skin in the shaving area between the two cutters, so that a gentle shaving process is obtained. The above shape and arrangement of apertures also has the advantage that the combined movement of the cutter blade provides a multitude of cutting actions in a plurality of cutting directions, which yields a rapid shave. Moreover, the arrangement of the cutting edges of the hair-entry apertures of the shear foil and the cutting edges of the hair-entry apertures of the cutter blade at an angle of 14.55° relative to one another has the advantage that during shaving a cutting edge of the shear foil can never assume a position parallel to a cutting edge of the cutter blade in spite of the large number of cutting edges, so that hairs are always severed between two cutting edges which subtend a minimum angle with one another, which is advantageous for a minimal load of the webs of the cutters and, consequently, for a minimal risk of breakage of these webs.

The step of making a shear foil with a perforate area thinner in its central perforate zone than in its peripheral perforate zone at least by means of lower raised edges of the apertures can be employed not only in a shaving apparatus corresponding to the exemplary embodiment described above but also in shaving apparatuses in which the lower cutter cooperating with such a shear foil does not perform a combined movement but merely a simple linear reciprocating movement.

We claim:

1. A shaving apparatus comprising a foil-like lower cutter having a shaving area defined by a circularly cylindrical surface and provided with hair-entry apertures which are separated from one another by webs and bounded by bounding surfaces, which lower cutter can be driven with a combined movement which is performed substantially along a circular path projected on a circularly cylindrical surface, and comprising a foil-like upper cutter having a shaving area engaging with the shaving area of the lower cutter and provided with hair-entry apertures which are separated from one another by webs and bounded by bounding surfaces, all the bounding surfaces of all the hair-entry apertures terminating in cutting edges, characterized in that in its planar condition the lower cutter has hair-entry apertures with six bounding surfaces terminating in six cutting edges arranged as a regular hexagon, said hexagonal hair-entry apertures being arranged in a honeycomb pattern, in its planar condition the upper cutter has hair-entry apertures with four bounding surfaces terminating in four cutting edges arranged as a square, each of these square hair-entry apertures belonging to two rows of square hair-entry apertures, which rows intersect one another at right angles, and a further hair-entry aperture is situated between every two adjacent square hair-entry apertures, which further hair-entry aperture has bounding surfaces terminating in cutting edges arranged in the form of a narrow slot, two of the cutting edges extending parallel to the adjacent cutting edges of the adjacent square hair-entry apertures, and when the cutters are superposed as in the shaving apparatus but are in their flat condition the direction of two mutually parallel cutting edges of the square hair-entry apertures of the upper cutter and the direction of two mutually parallel cutting edges of the hexagonal hair-entry apertures of the lower cutter subtend an angle between 5° and 25°.

2. A shaving apparatus as claimed in claim 1, characterized in that the angle has a value between 14° and 15°.

3. A shaving apparatus as claimed in claim 1, characterized in that in a planar condition of the lower cutter two mutually parallel cutting edges of the hexagonal hair-entry apertures of the lower cutter extend substantially perpendicularly to a straight line parallel to the cylinder axis of the circularly cylindrical surface of the shaving area of the lower cutter.

4. A shaving apparatus as claimed in claim 1, characterized in that in a planar condition of the upper cutter each of the hair-entry apertures situated between two adjacent square hair-entry apertures of the upper cutter has two long cutting edges, which extend parallel to the adjacent cutting edges of the adjacent square hair-entry apertures, and four short cutting edges, of which each time two short cutting edges converge to a wedge shape and of which each time two short cutting edges extend parallel to one of the two diagonal directions of the adjacent square hair-entry apertures.

5. A shaving apparatus as claimed in claim 2, wherein in a planar condition of the lower cutter two mutually parallel cutting edges of the hexagonal hair-entry apertures of the lower cutter extend substantially perpendicularly to a straight line parallel to the cylinder axis of the circularly cylindrical surface of the shaving area of the lower cutter.

6. A shaving apparatus as claimed in claim 2, wherein in a planar condition of the upper cutter each of the hair-entry apertures situated between two adjacent square hair-entry apertures of the upper cutter has two long cutting edges, which extend parallel to the adjacent cutting edges of the adjacent square hair-entry apertures, and four short cutting edges, of which each time two short cutting edges converge to a wedge shape and of which each time two short cutting edges extend parallel to one of the two diagonal directions of the adjacent square hair-entry apertures.

* * * * *